US005088384A

United States Patent [19]

Lonnemo

[11] Patent Number: 5,088,384

[45] Date of Patent: Feb. 18, 1992

[54] HYDRAULIC ACTUATOR CONTROLLED BY METER-IN VALVES AND VARIABLE PRESSURE RELIEF VALVES

[75] Inventor: Kurt R. Lonnemo, Bloomfield Hills, Mich.

[73] Assignee: Vickers, Incorporated, Troy, Mich.

[21] Appl. No.: 400,670

[22] Filed: Aug. 30, 1989

[51] Int. Cl.[5] ..... F15B 11/04

[52] U.S. Cl. ..... 91/461

[58] Field of Search ..... 91/461, 305

[56] References Cited

U.S. PATENT DOCUMENTS

| | | | |
|---|---|---|---|
| 4,201,052 | 5/1980 | Breeden et al. | 91/461 |
| 4,407,122 | 10/1983 | Nanda | 91/461 |
| 4,475,442 | 10/1984 | Breeden | 91/461 |

*Primary Examiner*—Edward K. Look
*Assistant Examiner*—F. Daniel Lopez
*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving an element of the actuator in opposite directions, a pump for supplying fluid to the actuator. A meter-in valve individual to each opening is provided to which fluid from the pump is supplied and a pair of lines extending from the respective meter-in valves to the respective openings of the actuator. A controller alternately supplies pressure to the respective meter-in valves for controlling the direction of movement of the load. A second pair of lines extends from the first pair of lines to tank and a variable pressure relief valve is positioned in each line of the second pair of lines. When the controller is moved to actuate one of the meter-in valves for supplying fluid to one of the openings of the actuator, the controller also actuates the variable relief valve associated with the line of the first pair of lines extending from the other of the openings of actuator to control the flow out of the other opening. The controller thus simultaneously controls the fluid flow and the pressure to the actuator and the fluid pressure from the actuator, thereby simultaneously controlling the driving and braking functions of the system.

12 Claims, 1 Drawing Sheet

HYDRAULIC ACTUATOR CONTROLLED BY METER-IN VALVES AND VARIABLE PRESSURE RELIEF VALVES

This invention relates to power transmissions and particularly to hydraulic circuits for actuators such as are found in excavators, backhoe-loaders and forestry equipment, like log loaders and feller-bunchers.

BACKGROUND AND SUMMARY OF THE INVENTION

Hydraulic systems for controlling the acceleration, velocity and deceleration of heavy loads and in particular swing drives, have typically made use of some form of pressure control.

An excellent example is the closed loop swing drive pump control described in Vickers U.S. Pat. No. 3,696,836 which provides true pressure control in both driving and braking mode. In neutral, this control provides for free coast, a characteristic very desirable for construction cranes.

In other applications, like excavators, backhoe-loaders and forestry equipment, like log loaders and feller-bunchers, the free coast is not acceptable—neutral lever position must give blocked port conditions.

In these applications, the most common method of deceleration or braking is to center the valve and utilize either port relief valves or cross port relief valves. Improvements to the above have been made by introducing two relief valve pressure levels (one for acceleration, one for deceleration), or pressure rate sensing relief valves to smooth the action. Nevertheless, the one large performance disadvantage with the above systems is when once the valve is centered, there is no control of where the swing will stop. The stop position depends on load inertia. Another disadvantage is that there is no way to stop the swing motion earlier, if desired.

Among the objectives of the present invention are to provide a hydraulic system wherein the swing motion of the device being controlled is controlled throughout the desired movement; wherein both acceleration and deceleration may be controlled by one input signal from the same controller; wherein both acceleration and deceleration of large inertia loads, for example swing drives, can be achieved; wherein control of acceleration and deceleration is achieved by controlling both accelerating pressure and decelerating pressure simultaneously; wherein the system functions on the basis of a difference between acceleration or driving pressure and deceleration or braking pressure; and wherein the pressure controlling the swing motion comprises the only actuator connection to tank.

In accordance with the invention, the hydraulic control system comprises a hydraulic actuator having opposed openings adapted to alternately function as inlets and outlets for moving an element of the actuator in opposite directions, a pump for supplying fluid to the actuator. A meter-in valve individual to each opening is provided to which fluid from the pump is supplied and a pair of lines extends from the respective meter-in valves to the respective openings of the actuator. A controller alternately supplies pressure to the respective meter-in valves for controlling the direction of movement of the load. A second pair of lines extends from the first pair of lines to tank and a variable relief valve is positioned in each of the second pair of lines. When the controller is moved to actuate one of the meter-in valves for supplying fluid to one of the openings of the actuator, the controller also actuates the variable operated relief valve associated with the line of the first pair of lines extending from the other of the openings of actuator to control the flow out of the other opening. The controller thus simultaneously controls the fluid flow and pressure to the actuator and controls the fluid pressure from the actuator thereby simultaneously controlling the driving and braking functions of the system.

DESCRIPTION

Figure 1:
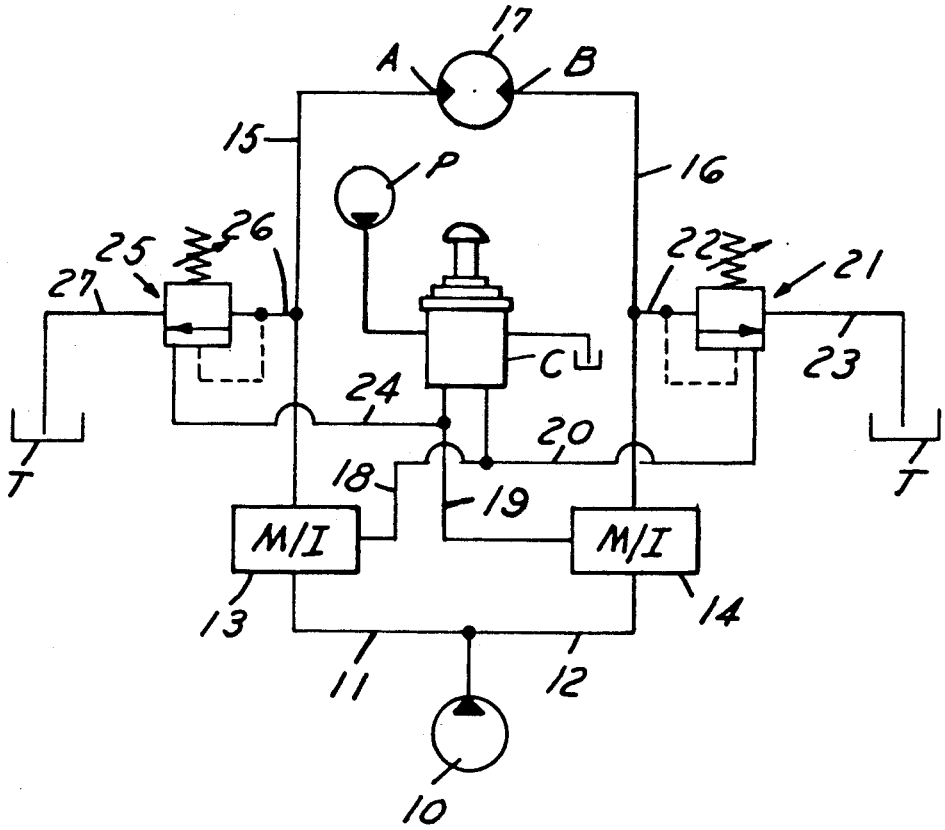
FIG. 1 is a schematic diagram of a hydraulic system embodying the invention.

Referring to FIG. 1, the hydraulic system embodying the invention comprises a pump 10 that supplies fluid under pressure though a first pair of lines 11, 12 through meter-in valves 13, 14 to lines 15, 16 and selective openings A and B of an actuator depending upon which of the meter-in valves 13, 14 is actuated.

A controller C, herein shown as a manual controller functions to supply pilot pressure from a pilot pressure pump P and produce a varying pilot signal through lines 18, 19 selectively to meter-in valves 13, 14.

The controller C also functions when moved in one direction to supply pilot pressure to line 18 to meter-in valve 13 to supply also pilot pressure through line 20 to a variable pressure operated relief valve 21 in line 22 connected to line 16 so as to control flow out of opening B permitting fluid to flow through line 23 to tank functioning to brake or decelerate the load.

Similarly, the controller C is connected so that when pilot pressure is applied through line 19 to meter-in valve 14 for controlling flow of fluid to opening B, pilot pressure is also supplied through line 24 to a pilot variable pressure controlled relief valve 25 in a line 26 connected to line 15 extending to opening A of the actuator 17 for controlling flow through line 27 to tank T.

Thus, the controller C when moved to supply pilot pressure to one meter-in valve for supplying fluid from the pump 10 to one of the openings functions also to supply pilot pressure to the pilot pressure relief valve controlling flow out of the other openings of the actuator.

The meter-in valves 13, 14 as shown and described on preferably of the metering flow controlling type shown and described in U.S. Pat. Nos. 4,201,052 or 4,253,157, incorporated herein by reference. In such a system, the maximum driving pressure is established by a pressure relief valve or by the pressure compensated pump, as shown in the patent.

The meter-in valves 13, 14 may also be of the metering pressure controlling type shown and described in U.S. Pat. No. 4,407,122 incorporated herein by reference.

The meter-in valves 13, 14 may also be of the on-off type and the system will provide a simultaneous control of acceleration and deceleration as presently described.

The meter-in valves 13, 14 may be part of a single valve body, as is well known in the art.

Figure 2:
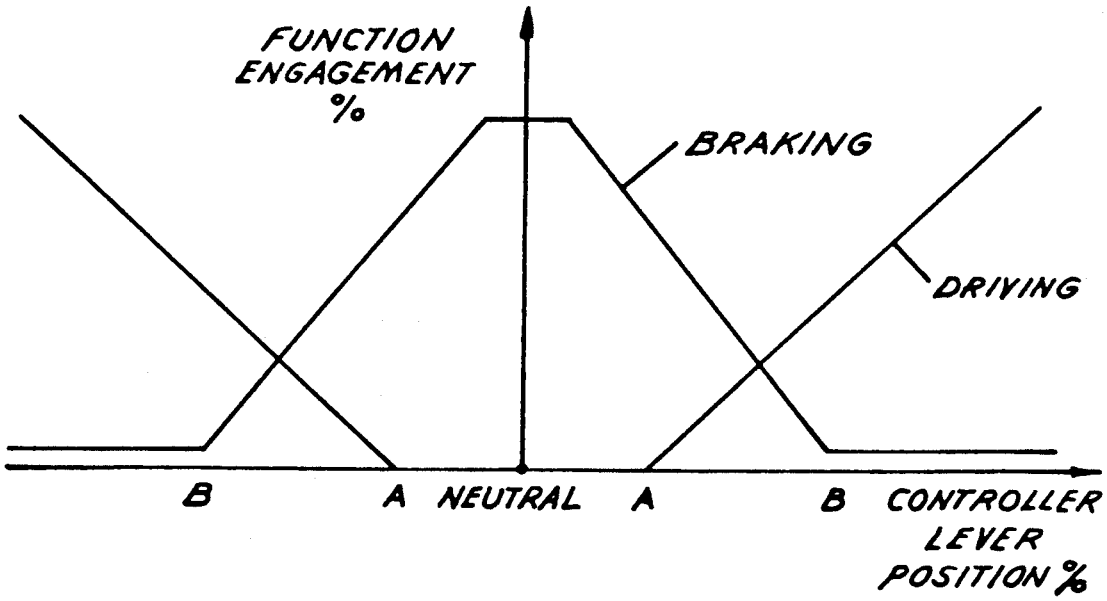
FIG. 2 is a graph of driving and braking functions versus positions of a controller in a hydraulic system embodying the invention.

Referring to FIGS. 1 and 2, in operation with the lever in neutral, both valve actuator ports are blocked and the maximum allowable actuator pressure levels are applied to the meter-in valves 13, 14 as set by relief valves 21, 25.

Moving the lever of controller C in either direction will initially proportionally lower the setting of one of the variable relief valves 21, 25 in the return line from the load.

After an appropriate amount of lever movement (point A in FIG. 2), the meter-in function will be increasingly engaged and supply flow to accelerate the load.

Controller C may be a manually operated hydraulic valve or an electrically operated variable valve such as a proportional solenoid valve. Alternatively, the controller C may comprise a mechanical device which functions to control the movement of one or the other of the meter-in valves 13, 14 and simultaneously control one or the other of the variable pressure relief valves 21, 25.

The driving pressure level can be determined by either the valve meter-in function or by the maximum system pressure limitation.

At another appropriate point (B) in FIG. 2 of the lever movement, the variable relief valve pressure setting has reached its minimum value, while the load driving flow and/or pressure is still increasing with increasing lever movement. Thus the driving torque is determined by the difference between the driving and braking pressure levels of which one or both can be fully controlled by the amount of lever movement (see FIG. 2).

During operation at constant speed, the velocity is selected by the amount of lever movement beyond point "A".

For deceleration, the lever is moved toward neutral causing the reverse of what is described above, i.e. decreasing driving flow and/or pressure and increasing braking pressure. By movement of the lever, the operator always has full control of either the driving or braking of the load within the maximum design parameters.

Thus, it can be seen that movement of the controller controls simultaneously on the driving side, the flow and/or pressure to the load, and on the outlet or downstream side of the load, the pressure level.

In can be seen that this differs from the currently employed pressure regulating systems where either the pressure/flow on the inlet side is controlled for acceleration or pressure on the outlet side for deceleration.

It can thus be seen that there has been provided a hydraulic system wherein the swing motion of the device being controlled is controlled throughout the desired movement; wherein both acceleration and deceleration may be controlled by one input signal from the same controller; wherein both acceleration and deceleration of large inertia loads, for example swing drives, can be achieved; wherein control of acceleration and deceleration is achieved by controlling both accelerating pressure and decelerating pressure simultaneously; wherein the system functions on the basis of a difference between acceleration or driving pressure and deceleration or braking pressure; and wherein the pressure controlling the swing motion comprises the only actuator connection to tank.

What is claimed:

1. A hydraulic control system comprising a hydraulic actuator having opposed openings adapted to alternately function as inlets and outlets for moving an element of the actuator in opposite directions, a pump for supplying fluid to the actuator, pilot pressure operated meter-in valves to which fluid from the pump is supplied, a first pair of lines extending from the respective meter-in valves to the respective openings of the actuator, a second pair of lines extending from the first pair of lines to tank and a pilot pressure operated variable pressure relief valve positioned in each line of the second pair of lines and comprising the sole means for permitting flow from the actuator to tank, each said pilot pressure operated variable pressure relief valve being such that at zero pilot pressure the pressure relief setting is at a maximum and as pilot pressure increases, the pressure relief setting will be proportionally lowered such that deceleration of the load is controlled solely by the pressure of flow from the actuator, a controller for alternately actuating a respective meter-in valve for controlling the direction of movement of the load, said controller being constructed and arranged such that when it is actuated to supply pilot pressure to one of the meter-in valves for supplying fluid through one of said first pair of lines to one of the openings of the actuator, the controller also provides pilot pressure to the pilot pressure controlled variable relief valve positioned in the other line of the second pair of lines associated with the other of said first pair of lines to the other opening of actuator to control the flow out of the other opening so that the controller substantially simultaneously supplies fluid to the actuator and controls the pressure of flow from the actuator thereby simultaneously controlling the driving function of the meter-in valve and the braking function of the pressure of flow from the actuator, and such that when the controller is moved from neutral in either direction, pilot pressure will progressively lower the setting of the variable pressure relief valve in the other line to control the pressure of flow from the actuator to decrease the braking of the load while the pilot pressure progressively moves the meter-in valve to increasingly engage and supply flow and pressure to accelerate the load, and such that when the controller is actuated to return toward neutral, the decreasing pilot pressure progressively increases the setting of the variable pressure relief valve to control the pressure of flow from the actuator to progressively increase the braking as well as progressively disengage the respective meter-in valve.

2. The hydraulic system set forth in claim 1 wherein each said pilot pressure operated meter-in valve and the associated pilot operated relief valve are so constructed and arranged that the control of the braking function of said actuator is initiated before the control of the driving function of said actuator.

3. The hydraulic system set forth in claim 2 wherein each pilot pressure operated meter-in valve and its associated pilot pressure operated relief valve are constructed and arranged such that the braking function reaches a minimum value while the driving function continues to increase as the pilot signal increases.

4. The hydraulic system set forth in claim 1 wherein said controller is of the manual type.

5. The hydraulic system set forth in claim 1 wherein said controller is of the electrohydraulic type.

6. The hydraulic system set forth in claim 1 wherein each said meter-in valve is of the pressure controlling type.

7. The hydraulic system set forth in claim 1 wherein each said meter-in valve is of the flow controlling type.

8. The hydraulic system set forth in claim 1 wherein each said meter-in valve is of the on-off type.

9. In hydraulic control system comprising a hydraulic actuator having opposed openings adapted to alternately function as inlets and outlets for moving an element of the actuator in opposite directions, a pump for supplying fluid to the actuator, a pilot pressure operated meter-in valve to which fluid from the pump is supplied, a first pair of lines extending from the respective meter-in valves to the respective openings of the actuator, the method of controlling the hydraulic system which comprises providing a pilot pressure operated variable relief valve in each line of a second pair of lines, said valve having a maximum pressure relief setting at zero pilot pressure and a pressure relief setting that is proportionally lowered as the pilot pressure increases, controlling the pilot pressure to the pilot pressure operated meter-in valve to control the movement of one or the other of the meter-in valves to supply fluid to one opening of the actuator, and simultaneously controlling the pilot pressure to a respective pilot pressure operated variable pressure relief valve such that increasing pilot pressure will progressively lower the setting of the variable pressure relief valve in the other line to control the pressure of flow from the actuator to decrease the braking of the load while the pilot pressure progressively moves the meter-in valve to increasingly engage and supply flow and pressure to accelerate the load, and such that when the controller is actuated to return toward neutral, the decreasing pilot pressure progressively increases the setting of the variable pressure relief valve to control the pressure of flow from the actuator to progressively increase the braking as well as progressively disengage the respective meter-in valve.

10. The method of controlling a hydraulic system set forth in claim 9 wherein said step of controlling the pressure of fluid out of the actuator comprises positioning a pilot pressure operated variable pressure relief valve in a line from said other opening of the actuator and utilizing a controller to variable control the pilot pressure to the meter-in valves and simultaneously control the pressure of flow from the other opening of the actuator.

11. The method of controlling a hydraulic system set forth in claim 10 including controlling the braking function such that it is initiated before the driving function.

12. The method of controlling a hydraulic system set forth in claim 11 including controlling the braking function such that it reaches a minimum value while the driving function continues to increase as the controller is moved.

* * * * *